United States Patent [19]

Cummins

[11] Patent Number: 4,457,375

[45] Date of Patent: Jul. 3, 1984

[54] FOAM GENERATING DEVICE FOR WELLS

[76] Inventor: Mark A. Cummins, 305 Delmas, Lufkin, Tex. 75901

[21] Appl. No.: 355,136

[22] Filed: Mar. 5, 1982

Related U.S. Application Data

[63] Continuation-in-part of Ser. No. 181,716, Aug. 27, 1981, Pat. No. 4,318,443, which is a continuation of Ser. No. 933,595, Aug. 14, 1978, abandoned.

[51] Int. Cl.[3] ..... E21B 7/18

[52] U.S. Cl. ..... 166/309; 175/69

[58] Field of Search ..... 175/69, 71; 166/90, 166/309, 311, 312

[56] References Cited

U.S. PATENT DOCUMENTS

| | | | |
|---|---|---|---|
| 639,024 | 12/1899 | Eggers . | |
| 1,753,429 | 4/1930 | Rice . | |
| 2,745,700 | 5/1956 | Phalen . | |
| 2,811,211 | 10/1957 | Eriksson . | |
| 2,842,465 | 7/1958 | Harrison . | |
| 2,860,856 | 11/1958 | Bauer . | |
| 2,880,965 | 4/1959 | Bobo | 175/69 |
| 2,908,334 | 10/1959 | Duggan et al. . | |
| 2,988,151 | 6/1961 | Dion-Biro . | |
| 2,990,885 | 7/1961 | Brazier . | |
| 3,122,327 | 2/1964 | Wiedorn . | |
| 3,130,798 | 4/1964 | Schramm et al. | 175/69 |
| 3,234,962 | 2/1966 | Williamson . | |
| 3,337,195 | 8/1967 | Farison . | |
| 3,463,231 | 8/1969 | Hutchinson . | |
| 3,465,827 | 9/1969 | Levy et al. . | |
| 3,493,059 | 2/1970 | Cox | 175/69 |
| 3,592,269 | 7/1971 | Stults . | |
| 3,593,800 | 7/1971 | Hutchison | 175/69 |
| 3,819,519 | 6/1974 | Sharman et al. | 175/69 |
| 3,979,326 | 9/1976 | Chatterton . | |

FOREIGN PATENT DOCUMENTS

| | | | |
|---|---|---|---|
| 275362 | 5/1967 | Australia . | |
| 25275 | 10/1974 | Australia . | |
| 388858 | 8/1935 | Canada . | |
| 506841 | 10/1954 | Canada . | |
| 378318 | 8/1932 | United Kingdom | 175/69 |
| 697028 | 9/1953 | United Kingdom . | |
| 752984 | 7/1956 | United Kingdom . | |
| 1051841 | 12/1966 | United Kingdom . | |
| 1176377 | 1/1970 | United Kingdom . | |

OTHER PUBLICATIONS

U.S. Department of the Interior document entitled "Water Expansion Evaluation", 1980.

An exerpt from the document "Fire Call" published in the U.S. Department of Interior, Bureau of Land Management, dated Nov., 1980.

"Charts Help Find Volume, Pressure Needed for Foam Drilling", Krug et al., The Oil and Gas Journal, Feb. 7, 1972.

*Primary Examiner*—Stephen J. Novosad
*Assistant Examiner*—William P. Neuder
*Attorney, Agent, or Firm*—Jerry W. Mills; Jerry R. Selinger; Gregory M. Howison

[57] ABSTRACT

A foam generating apparatus (10) is provided for circulation of foam within a well (12) for drilling, operation or clean out. A liquid foam generating solution (38) is pressurized by a pump (48). The solution flows through a passage in a mixing tee (66). The mixing tee has a second passage which permits a pressurized gaseous aeration agent (35) to be entrained within the fluid flow. The turbulence of flow and downstream pressures permit onset of foam generation within the well. The foam consistency can be controlled by varying the pressure of the aeration agent and foam generating solution to maximize the effectiveness of the circulation. The ratio of aeration agent and fluid generating solution can also be varied. Variation of the pressure and aeration agent-/foam generating solution ratio permits a range of foam to be created from wet flow for lifting fine particles and deep penetration in porous substances to a dry foam for lifting heavy particles with limited infiltration of foam within down hole materials.

4 Claims, 4 Drawing Figures

FOAM GENERATING DEVICE FOR WELLS

This application is a continuation-in-part of application Ser. No. 06/181,716 filed Aug. 27, 1981, now U.S. Pat. No. 4,318,443, which is a continuation of application Ser. No. 05/933,595 filed Aug. 14, 1979, now abandoned.

TECHNICAL FIELD

This invention relates to the generation of a foam, and more particularly to the generation of foam within a well or drilling environment.

BACKGROUND ART

Recently, a device has been developed for pumping preformed foam down hole in a well to create circulation in the well. This device is described in U.S. Pat. No. 3,463,231, issued Aug. 26, 1969 to Hutchinson, et. al. The foam has been useful in drilling operations, completion operation and maintenance functions, such as sand cleanout.

The foam circulation provides several advantages over more conventional drilling mud circulation. The relatively low hydrostatic head of the foam reduces damage to the oil bearing formation. This also reduces the risk of lost circulation within the formation which can occur with conventional drilling muds if the mud penetrates too far into the formation. The foam has also been found to be quite effective in lifting not only small particles, but relatively large particles having a diameter of several inches.

The preformed foam requires a special mixing aeration generator to create the foam prior to down hole flow. The generator creates foam by flow through porus and flow restricting devices. The generator is of fixed capacity to create a single density of foam. The inability to vary foam density prevents variation in the condition of the foam.

Foam flow requires a greater driving pressure than the pressure needed to flow the individual constituents of the foam. A need exists to control the foam consistency to optimize the foam's action, such as cleanout, at the critical section of the circulation, while minimizing flow constraints in circulation outside the critical region.

SUMMARY OF THE INVENTION

An apparatus is provided for generating and discharging foam within a well having a casing and a down hole pipe string having a passage formed therethrough. The apparatus includes a container structure for storing a liquid foam generating solution and structure for pressurizing the solution. A mixing structure having a first passage formed therethrough is placed in fluid communication with the solution in the container structure at a first end of the first passage. The opposite end of the first passage is in fluid communication with the passage in the down hole pipe string. The mixing structure is formed with a second passage opening into the first passage along its length. A tube structure is provided for introducing a pressurized gaseous aeration agent into the second passage. The pressurized gaseous aeration agent is entrained into the flow of the liquid foam generating solution within the mixing structure. The back pressure and frictional turbulence of the combined aerated flow in the well induces foam production in the flow within the well. The foam consistency is variable by regulating the pressure of the liquid foam generating solution and aeration agent.

In accordance with another aspect of the present invention, the pressures and ratio of the liquid foam generating solution and aeration agent are variable to selectively create foam within a range of properties from wet, thin foam for enhanced washing of fine particles and infiltration of porous substances to a thick, dry foam for enhanced lifting of large particles in the well.

In accordance with yet another aspect of the present invention, a method for circulating foam through a well is provided. The method includes the step of discharging pressurized liquid foam generating solution from a container through a mixing structure for flow into the passage within the pipe string within the well and return in the annular space between the pipe string and well to the surface. The method further includes the step of aerating the flow of the liquid foam generating solution with a pressurized gaseous aeration agent in the flow through the mixing structure. The method also includes the step of varying the pressure in the pressurized liquid foam generating solution and pressurized gaseous aerating agent to vary the foam consistency within the well.

BRIEF DESCRIPTION

A more complete understanding of the invention may be had by reference to the following detailed description when taken in conjunction with the accompanying drawings, wherein.

DETAILED DESCRIPTION

Figures 1, 2, 3, 4:
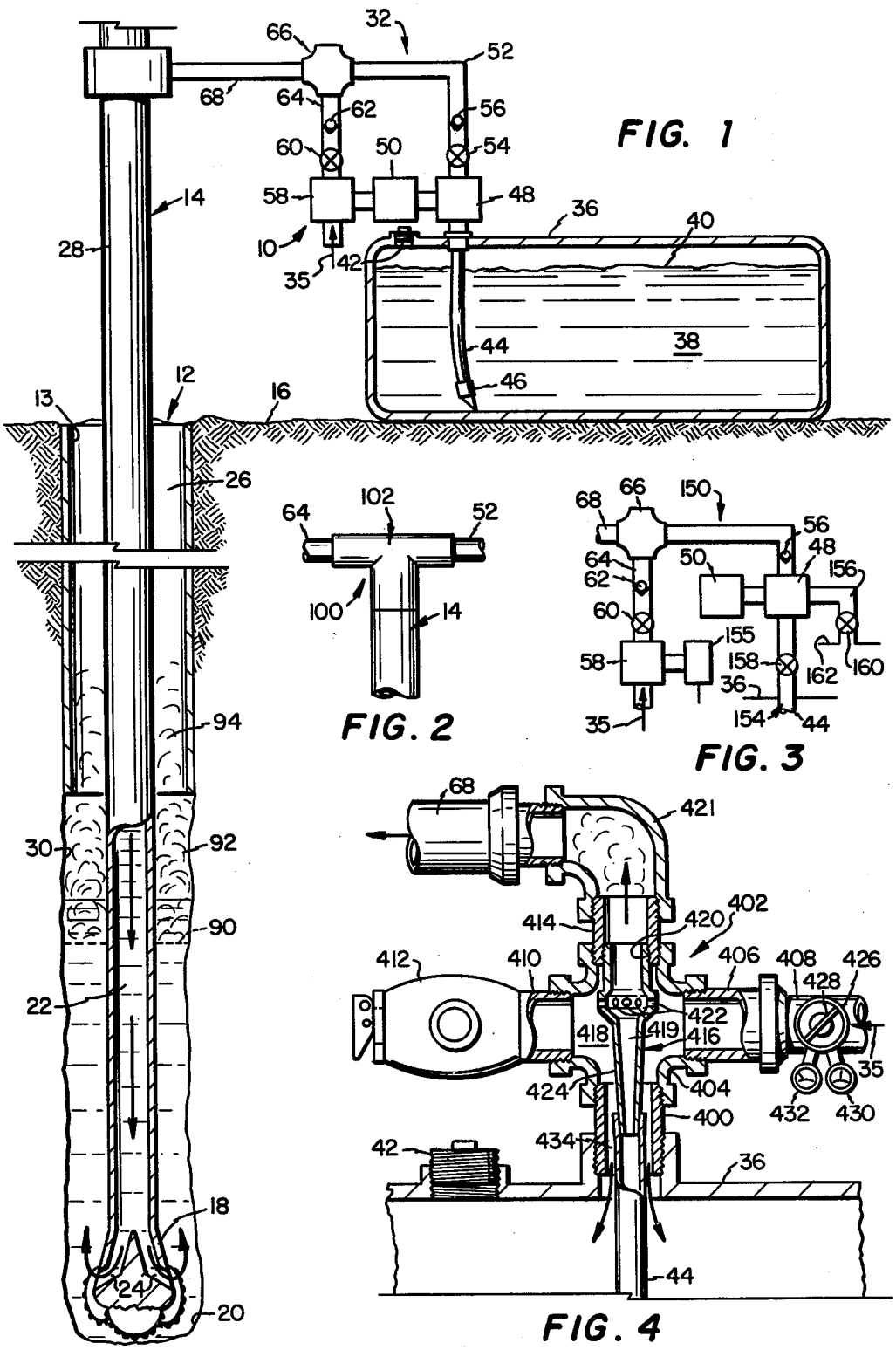
FIG. 1 is a schematic view of a foam generating apparatus forming a first embodiment of the present invention and a well in which the apparatus is employed.
FIG. 2 is a schematic view of a first modification of the apparatus.
FIG. 3 is a schematic view of a second modification of the apparatus.
FIG. 4 is a vertical cross section illustrating details of a third modification of the apparatus.

Referring now to the drawings, wherein like reference characters designate like or corresponding parts throughout the several views, FIG. 1 illustrates a foam generating apparatus 10 forming a first embodiment of the present invention adapted for use in a well 12 having a casing 13 extending down hole to the layers bearing oil or other fluid. A drill string pipe 14 extends from the surface 16 within the well 12. A drill bit 18 is mounted at the lower end of the drill string pipe 14. The drill string pipe 14 is rotated from the surface by a conventional mechanism to drill the well 12 by rotating the drill bit 18 against the working face 20 of the well.

In the conventional drilling operation, drilling mud would be pumped down the passage 22 formed within the drill string pipe and out ports 24 at the drill bit 18. The drilling mud collects cuttings and other debris at the working face and lifts it to the surface in the annular space 26 between the outer surface 28 of the drill string pipe 14 and the wall 30 of the well and inner surface of casing 13.

The present invention permits the drilling mud to be replaced by a foam circulation flow which achieves the same result in removing cuttings and debris and further provides several advantages over conventional drilling mud and presently employed foaming circulation systems. The foam generating apparatus 10 includes a foam mixing assembly 32 mounted on a container or tank 36.

The container 36 is adapted to carry sufficient foam generating solution 38 to undertake the necessary operation within the well. The tank is illustrated in FIG. 1 filled to the level 40. The foam generating solution can comprise any one of a combination of a number of fluids which are foamable upon aeration, such as readily available commercial foaming agents, foaming agents used in fire fighting (A.F.F.F. high-expansion foam, Protien foam), sulfate soap, or even common dishwater detergent. The preferred solution is sulfate soap which is a byproduct of the Kraft paper pulping process produced from a reaction of sodium hydroxide and certain wood-based resin and fatty acids. A plug 42 is threadedly received in the tank and removable for replenishing the fluid foam generating solution 38.

A flexible suction tube 44 extends into the foam generating solution 38. A weight 46 is mounted at the end of the suction tube 44 within the tank to maintain the open end of the tube approximately at the bottom of the tank. The tube 44 leads to a liquid pump 48. An engine 50 operates the pump 48 to pump solution 38 through line 52. Line 52 includes a shut off and control valve 54 and a one way check valve 56. The pump 48 can comprise a piston, gear, hydrostatic or gravity pump or other suitable pump. The pump can be replaced by a controllable liquid pressure source such as a pressure tank.

The engine 50, or a separate drive source, operates a gas compressor 58 to compress the aeration agent 35. The compressed aeration agent 35 passes through a shut off and volume control valve 60 and a check valve 62 in line 64.

Lines 52 and 64 extend to two ports in a mixing tee 66. The foaming solution and aeration agent are mixed within the tee and flow through the third opening in the tee along a connecting line 68 which extends to the pipe string and opens into the passage 22 within the pipe. A supply of compressed gas can be substituted for the gas compressor 58. The agent 35 can be, for example, nitrogen, carbon dioxide, halogen, or Freon gas, compressed air or any mixtures thereof.

As the aerated flow travels through the connecting line 68 and down hole within the drill string pipe 14 and returns to the surface in the annular space 26, the back pressure and friction of the aerated flow in the circulation passages mixes the foam generating solution 38 and the gaseous aeration agent 35. The aerated flow is mixed sufficiently within the bore hole to produce foam. With a set ratio of liquid and aeration agent, the increase in length of the path the aerated flow travels down hole causes the foam cells produced to divide into smaller cells which increases the density of the foam flow. The onset of foam generation is determined by a number of variables, including the initial pressure of the foam generating solution 38 and gaseous aeration agent 35, the ratio of solution 38 to gas 35 and the length and cross section of the tee 66, connecting line 64, passage 22 and annular space 26. The onset of foaming can therefore be controlled within the well by varying the pressure of the solution 38 and agent 35 and/or the ratio of the materials.

By increasing the amount of solution 38 relative to the aeration agent 35 down hole, the foam produced is more fluid saturated to produce a so-called "wet" foam. In this type of flow, the liquid content is high and the foaming is particularly effective in washing fine particles and infiltrating porous substances within the well.

An increase in the amount of aeration agent 35 relative to the solution 38 forced down hole creates a foam which is thicker and is a so-called "dry" foam. The liquid content in the dry flow is relatively low. The dry foam is particularly thick and has demonstrated a great ability to lift heavy solids, such as cuttings and debris with its flow.

The wetness or dryness of the flow can thus be adjusted by adjusting the relative ratio of gaseous aeration agent 35 and foam generating solution 38. This can be achieved by varying the respective pressures of the two materials with valves 54 and 60 to vary the compressability and density of flow. It can readily be seen that the ability to change the characteristics of the foam provides great advantages. The foam can initially be wet to wash fine particles. A simple adjustment will create a dry foam to lift liquids and heavy objects with a thick dense foam. Finally, the thick foam down hole can be driven upward and out of the well with only gas pressure to leave the hole empty and clean.

While the present invention is described and illustrated with respect to the drilling operation, the foaming properties can be employed in completion and maintenance of the well. The foaming circulation is particularly effective in sand cleanout within the well. It is also possible to inject other substances into the flow within the well during foam circulation. These substances can include chemicals to neutralize acid or other well treatment agents.

The capacity to vary the consistency of foam generation and the relative wetness or dryness of the flow provides other significant advantages to the foam circulation. In highly porous layers within the well, it would be desirable to have dry or heavy foam to prevent excessive absorption of the foam within the porous layers. The thermal resistance of the foam has been found very high and permits effective thermal insulation between the walls of the well and pipe string for use in steam recovery. The velocity of the foam flow is completely variable from a slow creep to a fast flow to achieve whatever purpose desired. The foam flow can be at a sufficiently low pressure to avoid formation damage within the well or the potential of lost circulation present in employing conventional drilling muds. The foam circulation is, as previously noted, achieved with a minimum pressure requirement for the surface equipment with the flexibility of controlling the foam characteristics to be most effective for a desired operation.

A first modification of the foam generating apparatus 10 is illustrated as apparatus 100 in FIG. 2. Several elements are identical and are identified by the same reference numeral as the apparatus of FIG. 1. A mixing tee 102 is mounted directly on the drill pipe string 14. The lines 52 and 64 approach the tee from opposite sides. This modification permits the fluid and gas pressurizing apparatus to be separated on opposite sides of the bore hole if desired.

A second modification of apparatus 10 is illustrated in FIG. 3 as apparatus 150. The apparatus 150 shares common elements with apparatus 10 and 100, which are also identified by identical reference numerals. Apparatus 150 includes a separate motor 155 to operate compressor 58. The pump 48 is supplied by dual inlet lines 154 and 156, each with a valve 158 and 160, respectively. Line 154 runs to a source of solution 38. The line 156 runs to a tank 162 holding a different liquid foaming solution. By operating valves 158 and 160 either one or a mixture of both foaming solutions can be used to generate foam. The tank 162 can also hold a treatment agent for mixture with solution 38 for treating the well.

In a third modification illustrated in FIG. 4, a fitting 400 is also threadedly received in the tank 36 and extends upward to support a foam mixing assembly 402. The assembly 402 includes a four port T connector 404 with the fitting 400 threaded into one of the ports. A fitting 406 is provided in another port of the connector for securing a gas pressure line 408 extending to a source of pressurized aeration agent 35. A fitting 410 in the port opposite the fitting 406 mounts a pressure release valve 412.

The final port receives a fitting 414 which has an internal thread receiving an ejector tube 416 extending downward through the cavity 418 within the connector 404. The other end of the fitting 414 mounts an elbow 421. The elbow, in turn, receives the connecting line 68 which extends to the pipe string and opens into the passage 22 within the pipe.

The ejector tube 416 comprises a generally elongate cylindrical member having a central passage 419 extending through the tube. The tube includes a threaded portion 420 for fastening to the fitting 414. A plurality of apertures 422 are disposed circumferentially and centrally about the tube to permit communication between the cavity 418 and the passage 419. Finally, a tapered portion 424 extends within the fitting 400 and accepts the flexible suction tube 44 extending into the foam generating solution 38. When the solution 38 is under pressure, it is urged through tube 44 and passage 419 into the well through passage 22.

Compressed air or another gaseous aeration agent 35 flows through line 408 for entry into the cavity 418 and entrainment within the flow of solution in the ejector tube 416 through apertures 422. The apertures are preferably positioned in an annular distribution transverse the direction of flow of solution 38. A regulator 426 is provided to control the gas pressure within the line 408 by handle 428. Gages 430 and 432 measure the upstream and downstream gas pressures at the regulator, respectively.

In the preferred construction, the passage 434 interconnects the cavity 418 with the interior of the tank 36. This permits the pressurized gas within the cavity 418 to likewise pressurize the interior of the tank 36 to force the foam generating solution 38 through the passage 419 in the ejector tube 416. However, an alternate construction can provide pressurization from an independent source, permitting the pressure in the cavity 60 to differ from the pressure within the tank 36.

While the present invention has been described for use in the down hole well environment, other uses of the invention are possible. The invention should be particularly effective in cleaning operations of almost any type, and other uses such as spraying of disinfectants and decontaminates.

Although a single embodiment of the invention has been illlustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A method for generating and circulating foam within a well during formation thereof comprising the steps of:

disposing a down hole pipe string in the well having a passageway therethrough and forming an annular channel around the pipe string;

pressurizing liquid foam generating solution with a selectively variable pressure;

entraining a pressurized gaseous aeration agent with a selectively variable pressure into the flow of liquid foam generating solution through a mixing structure;

discharging the mixed pressurized gaseous aeration agent and pressurized foam generating solution into the passageway in the pipe string for discharge at the down hole end of the pipe string for return to the surface in the annular space between the pipe string and well wall; and varying the relative pressures of the liquid foam generating solution and pressurized gaseous aeration agent to generate foam, with the onset of foam occurring within the passageway of the down hole drill string and with the foam consistency at the point of exit from the passageway in the pipe string into the well variable by selective variation of the solution and agent pressures as a function of the frictional turbulence in the passageway in the pipe string and the back pressure in the annular channel around the pipe string such that the increase in the length of the path the aerated flow travels down hole causes the foam cells produced to divide into smaller cells, thereby increasing the density of the foam flow.

2. The method of claim 1 further comprising the step of varying the pressure of the liquid foam generating solution and pressurized gaseous aeration agent to create foam with a range of properties from wet, thin foam for enhanced washing of fine particles and infiltration of porous substances to thick, dry foam for enhanced lifting of larger particles within the well.

3. The method of claim 1 further comprising the step of varying the ratio of entrained gaseous aeration agent to fluid foam generating solution by varying volume control valves in said pump and compressor means to create foam with a range of properties from wet, thin foam for enhanced washing of fine particles and infiltration of porous substances to thick, dry foam for enhanced lifting of large particles within the well.

4. The method of claim 1 comprising the step of selecting the foam consistency to maximize the effectiveness of the circulation.

* * * * *